United States Patent [19]

Seehausen

[11] 4,183,399

[45] Jan. 15, 1980

[54] HEAT PIPE RECUPERATOR

[75] Inventor: Jobst W. Seehausen, Upper St. Clair Township, Allegheny County, Pa.

[73] Assignee: Ionics, Inc., Watertown, Mass.

[21] Appl. No.: 925,739

[22] Filed: Jul. 19, 1978

[51] Int. Cl.[2] ..... E28D 15/00; F28F 27/02

[52] U.S. Cl. ..... 165/103; 165/105; 165/DIG. 12; 165/75; 165/76

[58] Field of Search ..... 165/105, DIG. 12, 103, 165/DIG. 2, 75, 76

[56] References Cited

U.S. PATENT DOCUMENTS

| | | | |
|---|---|---|---|
| 2,821,368 | 1/1958 | Essig | 165/75 X |
| 2,938,712 | 5/1960 | Pellmyr | 165/75 X |
| 3,779,310 | 12/1973 | Russell | 165/105 |

FOREIGN PATENT DOCUMENTS

| | | | |
|---|---|---|---|
| 713514 | 8/1931 | France | 165/103 |
| 498910 | 11/1954 | Italy | 165/105 |
| 197769 | 5/1923 | United Kingdom | 165/105 |
| 766786 | 1/1957 | United Kingdom | 165/105 |
| 767085 | 1/1957 | United Kingdom | 165/105 |

*Primary Examiner*—Albert W. Davis, Jr.
*Attorney, Agent, or Firm*—Norman E. Saliba

[57] ABSTRACT

A heat pipe recuperator for recovering heat from flue gas stacks is disclosed. The recuperator consists of a toroidal shell forming a fluid heating chamber having inlet and outlet fluid circulating ports. A plurality of heat pipes are mounted within the chamber and are attached to the inner wall of the shell such that the condensor sides of the pipe reside within the shell and the evaporator sides extend outside the shell into the center of the toroid. The recuperator is positioned in a flue gas stack wherein the hot flue gas stream contacts the heat pipes which transfer heat into the fluid heating chamber. Fluid, gas or liquid, is passed through the chamber resulting in a rise in temperature of the fluid.

1 Claim, 5 Drawing Figures

HEAT PIPE RECUPERATOR

BACKGROUND OF THE INVENTION

1. Field of the Invention:

The invention resides in the field of heat transfer devices and more particularly relates to recuperators for recovering waste heat from flue gases emanating from flue gas stacks.

2. Description of the Prior Art:

Recuperators as known in the prior art may have many different shapes and dimensions. The radiation type recuperator most suitable for high temperature heat recovery is essentially a vertical concentric double cylinder, forming a heat exchanger in which flue gas passes through the inner shell vertically upward and combustion air to be preheated is passed through the space between the two cylinders. A down flow arrangements is possible as well, but since most installations call for a discharge of the flue gas through a stack into the atmosphere, an upward flow is most common. Since the recuperator can act as a stack, this type of recuperator is often referred to as a stack type recuperator. An example of such apparatus is shown in U.S. Pat. No. 3,346,042, issued to the applicant.

A radiation recuperator of this type consists basically of two concentric large diameter metal shells welded together at each end by way of air inlet and outlet headers. Flue gases from a furnace pass through the inner shell while combustion air passes through the narrow gap between the shells. Heat from the flue gas is transmitted to the inner shell or heating surface mainly by gas radiation which may account for as high as 75 to 95% of the total heat transferred; additional heat is transferred by convection due to the flow of the flue gas through the recuperator, as well as by radiation from the hot flue canal into the recuperator. On the other side of the heating surface of the recuperator, the combustion air moves with high velocity, picking up heat by convection from the inner shell. Because the inner shell is much hotter than the outer shell, heat is radiated also to the outer shell across the air gap, resulting in a secondary heating surface formed by the outer shell from which the combustion air picks up heat by convection as well. Overall, a very complex system of heat transfer takes place between the flue gas and combustion air. Despite extremely high flue gas temperatures of up to 2500° F. entering such a recuperator, and air preheats of up to 1400° F., actual metal temperatures may not be higher than 1600° F. under normal operating conditions. If, however, the fuel input into the furnace is turned down, for example to 25% or less of maximum conditions, metal temperatures may rise to 1800° F. In case of power failures, temperatures may briefly reach 2000° F. and more. As stated above, the greatest part of the heat contained in the flue gas is transmitted to the heating surface or or inner shell by gas radiation, which does not depend on the velocity of the flue gas, while the cooling of the recuperator from the combustion air side depends entirely on velocity. The result is higher metal temperatures of the recuperator under low flow and power failure conditions, assuming that the flue gas temperature entering the recuperator is maintained at a high level, which is often the case at low fire conditions.

The above described high temperature conditions require these recuperators to be constructed of large, carefully made, metallic cylinders highly resistant to oxidation, corrosion and temperature. Despite refined design techniques, these prior art devices eventually deteriorate due to the environmental stresses they are constantly subjected to.

The present invention is intended to replace or augment radiation recuperators of the large cylindrical shell type while avoiding the difficulties enumerated above, since gas radiation is a function of approximately the fourth power of the absolute gas temperature and therefore is highly dependent upon flue gas temperatures.

SUMMARY OF THE INVENTION

The invention may be summarized as a flue gas heat pipe recuperator, consisting of an essentially toroidal shell, forming a fluid heating chamber, in which are mounted a plurality of heat pipes having their condensor ends within the shell and their evaporator ends outside the shell in the center of the toroid. The recuperator is placed in the path of the flue gas either in a stack or in an existing radiation recuperator. Heat is transferred through the pipes by liquified potassium or sodium by action of a wick when hot flue gases contact the evaporator portion of the pipes.

A fluid, most typically combustion air to be used by the furnace producing the flue gas, is passed through the chamber where it is heated by contact with the condensor ends of the pipes. Other fluids (liquids undergoing industrial processing for example) may be similarly heated since the chamber is sealed.

The advantages of the invention over the large cylindrical radiation type recuperators described above are many. Among them are the following.

There is no contamination of the heated fluid since heat transfer takes place in a sealed chamber. There are no moving mechanical parts since heat pipes are self pumping. The size of the unit is substantially smaller and lighter than existing devices and smaller blowers are needed to transport the fluids to be heated through the system. Thermal expansion problems are minimized as is the likelihood that the system will deteriorate and fail through collapse and burnout.

The rapid heat transfer provided by heat pipes yields increased efficiency and allows the unit to be used in higher temperature gas streams than would be possible with existing recuperators. Maintanance, cleaning and pipe replacement for example, are easily accomplished as is the installation of the device itself as a result of its relatively compact size.

These and other features and advantages of the invention will be more fully understood from the description of the preferred embodiment taken with the drawings which follow.

DESCRIPTION OF THE PREFERRED EMBODIMENT

Figure 1:
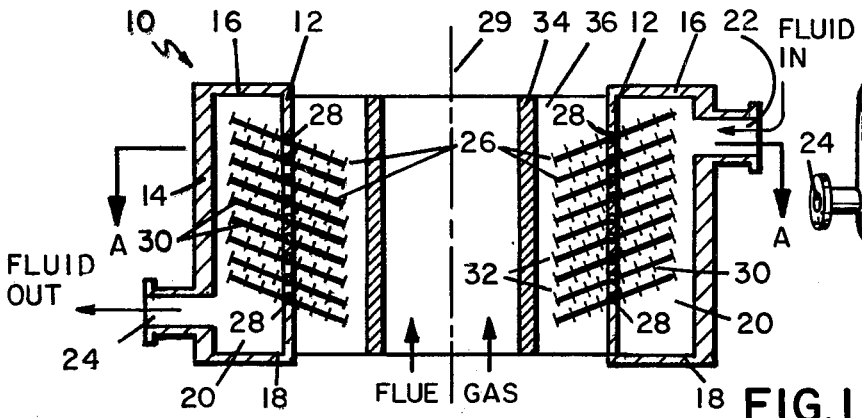
FIG. 1 is a side cross sectional view of the preferred embodiment of the invention.

Referring first to FIG. 1, there is shown a side cross sectional view of the preferred embodiment of the invention. A toroidal shell 10 forms the basic structure of the recuperator and consists of an inner wall 12, and outer wall 14, an upper cover plate 16 and a lower cover plate 18. The walls and plates together define a fluid heating chamber 20 having inlet port 22 and outlet port 24. Heat pipes 26 are thread mounted on inner wall 12 at points 28. They may be mounted orthoganally to the toroid axis 29 or perferably slanted as shown to insure proper liquid flow within the pipes. The condensor ends 30 of the pipes are contained within the chamber 20 while the evaporator ends 32 extend into the center of the toroid through which, when the recuperator is installed, hot flue gases pass.

An additional inner cylinder 34 supported by plates 36 may optionally be provided to reinforce the structure and to contain, if desired, a damper assembly for controlling the rate of emission of flue gas.

Figure 3:
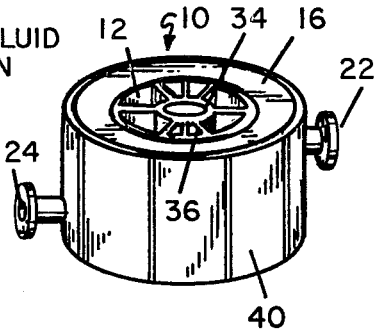
FIG. 3 is a perspective view of the apparatus of FIGS. 1 and 2.
Figure 2:
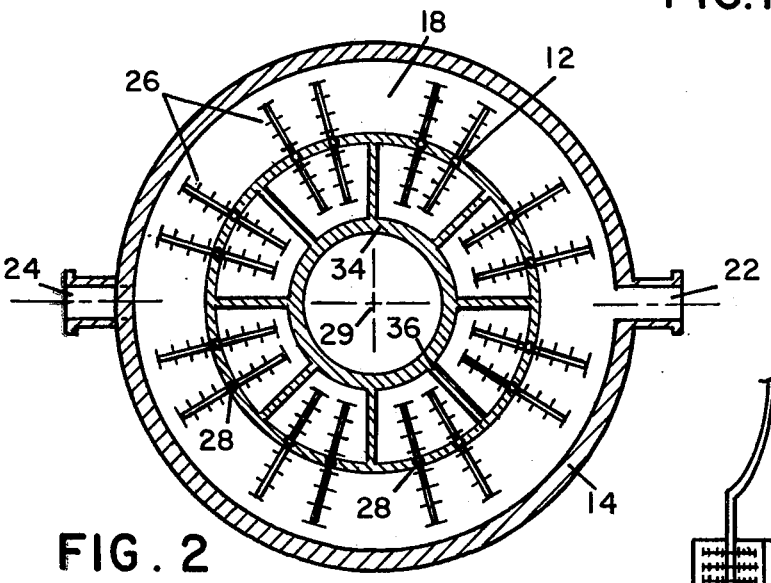
FIG. 2 is a top cross sectional view along line A—A of FIG. 1.

Referring next to FIG. 2, a top cross sectional view of FIG. 1 along line A—A is shown in which like numerals refer to like parts. FIG. 3 is a perspective view of the previously described apparatus where in outer wall is shown composed of removeable panels 40 which may optionally be provided for access to the heat pipes when the recuperator is installed. Each panel is removeable to expose a group of pipes which are arranged in radially disposed layers as indicated in the previous figures. In this manner, individual pipes may be periodically unscrewed from the inner wall, examined, and replaced as required.

Figure 4:
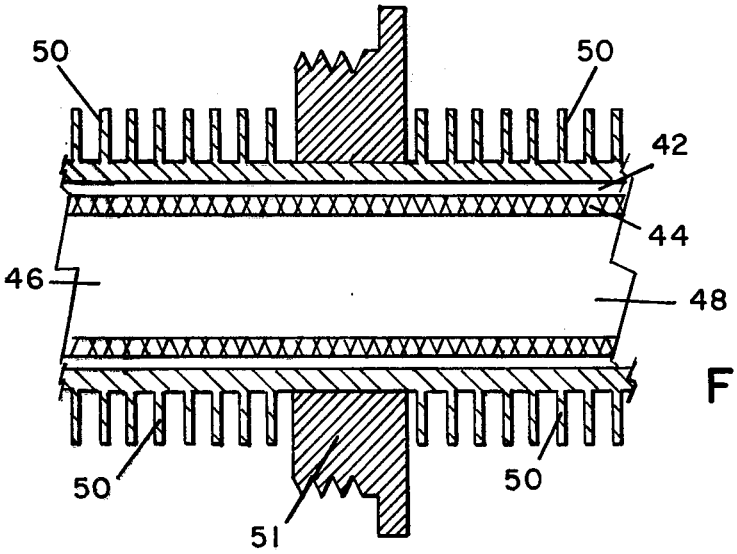
FIG. 4 is a cross sectional view of a portion of heat pipes which may be employed in the preferred embodiment.

FIG. 4 illustrates in partial cross sectional format the configuration of a typical heat pipe which may be used in the recuperator. The pipe is composed of a closed tube 42 having an internal wick 44 for conducting melted materials such as sodium or potassium from a heat receiving or evaporator end 46 to a heat releasing or condensor end 48. Fins 50 enlarge the surface area of the pipes and improve their heat transfer efficiency. Threaded flange 51 provides means for mounting the pipes on the inner wall. Heat pipes which are suitable for inclusion in the recuperator are fabricated by Westinghouse Electric Corporation.

Figure 5:
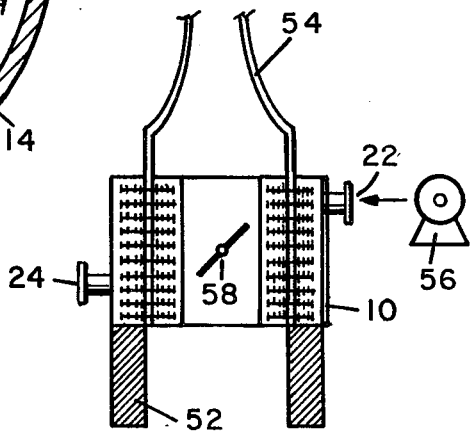
FIG. 5 is a cross sectional view showing one manner of employing the invention.

The installation of the invention in a flue gas path is illustrated in FIG. 5. The recuperator may be positioned just after the flue 52 of a furnace and before the chimney or stack 54. Pump means 56 is used to circulate fluid, most often combustion air, through the heating chamber. Damper 58 is used to adjust the rate of flow of flue gas out of the furnace.

Modifications of the preferred embodiment and variations in the manner of use of the invention may be made as will be obvious to those familiar with the art. For example, although the fluid heating chamber is shown as rectangular in shape, it may be circular or oval or of similar curved cross section to allow for even pressure distribution of heated fluids within the chamber. The heat pipes may be held in place by bolts or permanently mounted by welding. The size of the heating chamber may be selected independently of the flue gas passage in accordance with the type and column of fluid to be heated.

The recuperator may be used along or in combination with a stack type radiation recuperator, mounted above, below or in a bypass of the stack, and may be used to heat combustion air or other gases or liquid used in an industrial process in which the furnace is employed.

Since certain changes may be made in the above apparatus without departing from the scope of the invention herein involved, it is intended that all matter contained in the above description as shown in the accompanying drawings shall be interpreted as illustrative and not in a limiting sense.

The embodiments of the invention in which an exclusive property or privilege is claimed are defined as follows:

1. A flue gas heat pipe recuperator comprising:

a. an inner cylindrical shell defining a flue gas passage;

b. damper means within said inner cylinder for restricting the flow of flue gas through said cylinder;

c. an outer cylindrical shell having an inlet and outlet port;

d. an upper cover joining said inner and outer shells;

e. a lower cover joining said inner and outer shells, said shells and said covers defining a fluid heating chamber;

f. a plurality of heat pipes radially thread mounted within said chamber, said pipes having evaporator and condensor sections, said pipes extending through and supported by said inner cylinder such that said evaporator sections are positioned in said flue gas passage; said pipes slanted within said chamber having their condensor sections nearer the upper cover than the lower; and g. a plurality of fins disposed transverse the longitudinal axis of said pipes for increasing their heat transfer characteristic.

* * * * *